US008562821B2

(12) United States Patent
Nanoti et al.

(10) Patent No.: US 8,562,821 B2
(45) Date of Patent: Oct. 22, 2013

(54) PROCESS FOR THE REMOVAL OF SULFONES FROM OXIDIZED HYDROCARBON FUELS

(75) Inventors: Anshu Nanoti, Dehradun (IN); Soumen Dasgupta, Dehradun (IN); Amar Nath Goswami, Dehradun (IN); Bhagat Ram Nautiyal, Dehradun (IN); Tumula Venkateshwar Rao, Dehradun (IN); Bir Sain, Dehradun (IN); Yogendra Kumar Sharma, Dehradun (IN); Shrikant Madhusudan Nanoti, Dehradun (IN); Madhukar Onkarnath Garg, Dehradun (IN); Pushpa Gupta, Dehradun (IN)

(73) Assignees: Council of Scientific & Industrial Research Center for High Technology, New Delhi (IN); Ministry of Petroleum & Natural Gas (IN)

( * ) Notice: Subject to any disclaimer, the term of this patent is extended or adjusted under 35 U.S.C. 154(b) by 764 days.

(21) Appl. No.: 12/634,312

(22) Filed: Dec. 9, 2009

(65) Prior Publication Data

US 2011/0084002 A1 Apr. 14, 2011

(30) Foreign Application Priority Data

Dec. 15, 2008 (IN) ..... 2825/DEL/2008

(51) Int. Cl.
*C10G 25/00* (2006.01)
*C10G 25/12* (2006.01)

(52) U.S. Cl.
USPC ..... 208/245; 208/208 R; 208/250

(58) Field of Classification Search
USPC ..... 208/208 R, 245, 250
See application file for complete search history.

(56) References Cited

U.S. PATENT DOCUMENTS

| | | | | |
|---|---|---|---|---|
| 5,538,710 | A * | 7/1996 | Guo et al. | 423/701 |
| 7,094,333 | B2 * | 8/2006 | Yang et al. | 208/250 |
| 7,186,328 | B1 * | 3/2007 | Schultz et al. | 208/213 |
| 2005/0150156 | A1 * | 7/2005 | Karas et al. | 44/604 |
| 2006/0180501 | A1 * | 8/2006 | Da Silva et al. | 208/208 R |
| 2008/0099375 | A1 * | 5/2008 | Landau et al. | 208/244 |
| 2008/0308463 | A1 * | 12/2008 | Keckler et al. | 208/249 |

* cited by examiner

*Primary Examiner* — Walter D Griffin
*Assistant Examiner* — Renee E Robinson
(74) *Attorney, Agent, or Firm* — K&L Gates LLP

(57) ABSTRACT

Described herein is a process for the removal of sulfones by mesoporous silica adsorbents having narrow pore size distribution which could be controlled to specification for the selective removal of sulfones from oxidized hydrocarbon fuels wherein the sulfones were present due to oxidative conversion of organo-sulfur compounds by a suitable oxidizing solution. The mesoporous adsorbents showed typically 2-18 times higher equilibrium loading capacity for sulfones in comparison to the commercially available adsorbents.

14 Claims, 2 Drawing Sheets

PROCESS FOR THE REMOVAL OF SULFONES FROM OXIDIZED HYDROCARBON FUELS

CROSS REFERENCE TO RELATED APPLICATIONS AND PRIORITY CLAIM

This application claims the benefit of and priority under 35 U.S.C. §119 to Indian Patent Application No. 2825/DEL/2008, filed Dec. 15, 2008, which is incorporated herein by reference in its entirety.

FIELD OF THE INVENTION

Some example embodiments of the present invention relate to a process for the removal of sulfones from oxidised hydrocarbon fuels. Some particular example embodiments relate to a process for the removal of sulfones by using modified mesoporous adsorbents from oxidized hydrocarbon fuels such as oxidized diesel fuel, gasoline, jet fuel, fuel oils, coal liquids and similar petroleum products. More particular example embodiments of the present invention relate to a process for the removal of sulfones by using modified mesoporous silica based adsorbents, from oxidised hydrocarbon fuels like for example oxidized diesel fuels, gasoline, jet fuel oils, coal liquids, lube oils, waxy distillates and similar petroleum products, wherein the original organo-sulfur compounds present, such as thiophene, substituted thiophenes, benzothiophene, substituted benzothiophenes, dibenzothiophene and substituted dibenzothiophenes etc. have been fully converted to their corresponding sulfones by use of a suitable oxidizing agent.

BACKGROUND

Increased industrial activities and a rapidly escalating increase in demand of fossil fuel for power generation and transportation, has led to increased emission levels which has demanded highest scrutiny with respect to the health hazard and environmental pollution. A key pollutant in hydrocarbon transportation fuels is sulphur which apart from being responsible for formation of harmful sulphur di-oxide emissions during fuel combustion, also causes poisoning of the catalytic converters in automobiles in turn leading to increase in NOx emissions.

New fuel quality standards are being imposed for the control of such emissions through reduction in sulfur content in the hydrocarbon fuels. There are several approaches for such desulfurisation of hydrocarbon fuels. Some of these approaches were particularly examined to achieve ultra deep desulfurisation. The conventional hydro-desulfurisation of hydrocarbon fuels being currently practiced in the petroleum refining industry involves contacting of hydrogen with the hydrocarbon stream in presence of catalyst at elevated temperatures and pressures to convert sulfur compounds present therein to hydrogen sulfide in. This hydro-desulfurisation process is at present unable to achieve ultra low sulphur levels in the fuel due to low reactivity of refractory sulfur species under conventional conditions and also strong inhibition of the reaction by the reaction products $H_2S$, $NH_3$, nitrogen and even aromatic species. The environmental regulations in US and European countries call for a reduction in sulfur content to as low as 10 ppm. To achieve these goals, the operating conditions of hydrodesulfurisation need to be more severe with respect to temperature and pressure and this may lead to increased process cost. Among the new alternative approaches being studied, oxidative desulfurisation (ODS) appears to be particularly promising mainly due to ambient temperature and pressure operating conditions, which permits a significant cost reduction. In such a process, sulfur compounds present in the hydrocarbon fuels are oxidized by an oxidant into sulfones and sulfoxides, which are subsequently removed from the oxidized fuel by taking advantage of their different chemical and physical characteristics. The efficiency and economics of an oxidative desulfurisation process is strongly dependant on the method used for separating the sulfones/sulfoxides from the oxidized fuels.

Several separation methods have been suggested for use in removal of oxidized sulfur from hydrocarbon fuels. These methods use either solvent extraction, catalytic decomposition or adsorption. Reference may be made to Collins et al (Journal of Molecular Catalysis A: Chemical 117, 1977, 397) who reported the removal of sulfones from gas oil by solvent extraction using γ-butyrolactone as solvent or by adsorption on silica gel to obtain ultra low sulfur gas oil. F. Zannikos et al (Fuel Processing Technology, 42, 1995, 35) discussed solvent extraction route using polar solvents such as N-methylpyrrolidone (NMP), methanol, dimethylformamide (DMF) to remove oxidized sulfur from hydrocarbon fuel However he noted that there were significant losses (approx 30%) of usable oil which would not make the process economical despite advantages of low temperature and pressure operation.

U.S. Pat. No. 6,160,193 discloses a process also based on extraction of oxidized sulfur with insoluble polar solvents like dimethylsulfoxide (DMSO) thereby reducing the losses of the usable oil somewhat but losses were still significant. Otsuki et al (Energy and Fuels, 14, 2000, 1232) studied the removal of oxidized sulfur compounds by extraction using N,N dimethylformamide, acetonitrile, methanol, dimethylsulfoxide and sulpholane as solvent. Mei et al (Fuel 82, 2003, 405) reported removal of sulfones from diesel using solvent acetonitrile.

In general one of the major drawbacks of solvent extraction method is the appreciable solubility of hydrocarbon fuels in polar solvents with which leads to significant losses of usable hydrocarbon fuel. Such a loss is completely unacceptable on a commercial basis. Beside this, sulfones are polar compounds and form strong bonding with polar solvents and it is difficult to remove them from the solvents to below 10 ppm. Hence there will be build-up of sulphones in the solvent during solvent recovery for recycle. Moreover the integrated extraction of sulfones by polar solvents also makes the process flow scheme more complicated due to increase in the numbers of columns required in various steps such as extraction, raffinate wash column, solvent recovery column, and extract wash column.

Apart from solvent extraction, use of a large number of commercially available adsorbents has also been reported in the prior art for the selective removal of oxidized sulfur compounds. Reference may be made to U.S. Pat. No. 5,958,224 which discloses a process for removal of sulfones by adsorption on solid adsorbents such as activated carbon, bauxite, clay, coke, alumina or silical gel with pores large enough to adsorb the multi ring oxidation product. However the amount of oil treated per unit weight of adsorbent in this particular process is low and the process was not described with actual hydrocarbon fuels but with model hydrocarbon feed. US patent application 20040007501 discloses a process for the desulfurisation of sulfur containing hydrocarbon fuel by treating it with an oxidizing agent and subsequent removal of oxidized sulfur compounds with a sorbent comprising a promoter metal component and zinc oxide followed by regeneration of sulfur loaded sorbent with an oxygen containing regeneration scheme. The process condition requires very high pressure (35 bar) and high temperature (398° C.) and presence of hydrogen. U.S. Pat. No. 6,368,495 discloses a process for the oxidation of thiophenes and thiophene derivatives present in petroleum fraction to sulfones followed by decomposition of sulfones using catalyst like double layer hydroxides, molecular sieve, inorganic metal oxides or a mixture thereof. The process is carried out at pressure of 7 bar and temperature of around 475° C. A 40 to 74% decrease in sulfur level was achieved after 50 hours time on stream. Ishihara et al (Applied Catalysis A. General 279, 2005, 279) reported oxidation of sulfur compounds present in desulfurised light gas oil with sulfur content 40 ppm followed by removal of the sulfones formed by adsorption over silica gel. A low breakthrough capacity of around 0.2 mg/g was reported. European patent 0565324 A1 mentioned a method for removal of organic sulfones by adsorption on alumina or silica. WO patent 2005019386 discloses an integrated process for deep desulfurization of hydrocarbonaceous fuels by HDS followed by oxidation of the remaining sulfur compounds present and their subsequent removal by adsorption over microporous solids such as silicalite, ZSM-5, zeolite beta, zeolite L, zeolite X and Y. U.S. Pat. No. 6,402,940 discloses a process for desulfurization of fuels such as diesel oil and similar products which involves oxidation of sulfur compounds with a oxidizing solution to sulfones and followed by separation of sulfones by adsorption on alumina with a typical sulfur breakthrough capacity of 2 mg/g which is very low.

In summary the various techniques based on solvent extraction and adsorption with microporous adsorbents as revealed in the prior art for the removal of oxidized sulphur compounds from hydrocarbon fuels suffer from major drawbacks of low product yields and build up of sulphones in the solvent in case of solvent extraction processes and low adsorbent capacity for sulphones in case of adsorption processes. In recent years much attention has been paid to the development of ordered mesoporous oxide based materials due to their large pore sizes and controlled pore size distribution which may be beneficial in allowing accessibility of large molecules to the surface active sites. It is worth mentioning here that these mesoporous materials can be tailor made with respect to their surface and pore characteristics to suit to a large number of applications such as catalysis and adsorption. Feng et al (Science 276, 1997, 923) described an application of functionalized mesoporous material for the efficient removal of mercury. Damian Perez Quintanilla et al (Journal of Materials Chemistry 2006, 16, 1757) showed the use of chemically modified mesoporous silica for adsorption of Cd(II) from aqueous media. Zheng Yan et al (Journal of Materials Chemistry 2006, 16, 1717) reported the application of pyridine functionalized mesoporous silica as an efficient adsorbent for the removal of acid dyestuff. U.S. Pat. No. 6,756,022 describes a two step process for the adsorption of un-oxidized organo-sulphur compounds from fuels using FSM type mesoporous silica materials. This step is followed by in-situ oxidation of adsorbed organo-sulphur compounds to sulfoxides/sulfones which are subsequently desorbed from the mesoporous materials and further recaptured by another adsorbent (active clay or zeolite). There is a large scope for mesoporous material based adsorbents for the selective removal of sulfones and sulfoxides from oxidized hydrocarbon fuels, particularly since their pore sizes can be controlled to ensure accessibility of the large sulphone molecules into the adsorbent. However the prior art does not reveal any use of ordered mesoporous material for adsorption of oxidized sulfur compounds from hydrocarbon fuels.

SUMMARY

One example embodiment of the present invention provides a process for the removal of sulfones from oxidized hydrocarbon fuels, which comprises passing the sulfones containing oxidized liquid hydrocarbon fuel continuously over a fixed bed containing modified mesoporous silica adsorbent having pore size in the range of 26-60 A°, BET surface area in the range of 700-950 m2/g, pore volume in the range of 0.4-0.9 cm3/g, pre activated at a temperature of 350° C., at a weight hourly space velocity (WHSV) in the range of 1-20 $h^{-1}$, at an adsorption temperature of 20-30° C., at one bar pressure and collecting hydrocarbon and regenerating the adsorbent by passing an organic solvent over the fixed bed for a period of 20-30 minutes for further adsorption of sulfones.

In an example embodiment of the present invention, the liquid hydrocarbon fuel used is selected from the group consisting of diesel fuel, gasoline, jet fuel oil, coal liquids and similar petroleum products like Straight Run Kerosine, Light Cycle oil, Vacuum gas oil etc. containing sulfur compounds in the form of sulfones with total sulfur content preferably less than 500 ppm.

In another example embodiment of the present invention, the modified silica adsorbent used is siliceous material with or without metal impregnation.

In yet another example embodiment of the present invention, the metal used is a transition or a non transition metal selected from the group consisting of aluminum, cerium, nickel, copper, iron and titanium.

In yet another example embodiment, the modified silica adsorbent used has the following characteristics:

BET surface area in the range of 700-950 $m^2/g$, pore volume in the range of 0.4-0.9 $cm^3/g$, pore size in the range of 26-60 A°.

In yet another example embodiment, the equilibrium sulfur loading capacity of the modified silica adsorbent used is in the range of 7-11.5 mg/g of adsorbent.

In yet another example embodiment, the weight hourly space velocity (WHSV) of the hydrocarbon feed is in the range 1-20 $h^{-1}$ and preferably in the range of 1-10 $h^{-1}$.

In yet another example embodiment, the organic solvent used for regenerating the adsorbent is selected from methanol, ethanol, acetone and mixture thereof.

In yet another example embodiment, the desulphurization of the hydrocarbon obtained is in the range of 80-90%.

In yet another example embodiment, of the present invention, MMS class adsorbents with pore size in the range of 20 to 30 Å is prepared in an alkaline medium by combining a suitable silica precursor, from sources such as tetraethoxyorthosilicate, sodium silicate, and fumed silica etc., with an aqueous solution of cationic surfactant of the generalized formula $(C_nH_{2n+1}N(C_mH_{2m+1})_3]^+X^-$ where n=10 to 20, m=1 to 3 and X may be any univalent anion.

In yet another example embodiment of the present invention, MMS class adsorbents with pore size in the range of 20 to 30 Å is prepared in an alkaline medium by combining a suitable silica precursor, from sources such as tetraethoxyorthosilicate, sodium silicate, and fumed silica etc., with an aqueous solution of cationic surfactant of the generalized formula $[(C_nH_{2n+1}N(C_mH_{2m+1})_3]^+X^-$ where n=10 to 20, m=1 to 3 and X may be any univalent anion and a metal salt solution with the metal ion belonging to transition or non transitional series.

In yet another example embodiment of the present invention, the mole ratio of silicon to surfactant in the synthetic gel is kept in the range 30:1 to 1:1 preferably in the range of 10:1 to 5:1.

In yet another example embodiment of the present invention, pore volumes of the MMS class adsorbents are further increased by incorporating organic co-solvent such as but not limiting to hexane, toluene, isopropyl alcohol etc. into the micellar template during the organization of mesostructure.

In yet another example embodiment of the present invention, MMW class adsorbents with 50-80 Á are prepared in acidic medium by combining a suitable silica precursor with aqueous solution of block copolymers of oxyethylene-oxypropylene type having molecular weight in the range of 1000 to 20000.

In yet another example embodiment of the present invention, silicon to polymer mole ratio in the synthetic gel for MMW class material is kept in the range of 100:1 to 10:1.

In yet another example embodiment of the present invention, the final mesoporous adsorbents are prepared by calcining as synthesized silica-surfactant composite or the silica-polymer composite as the case may be, in the temperature range 200 to 550° C. under flowing air preferably in the range 50 to 200 ml/minute and with linear temperature rise at a rate preferably in the range 1 to 5° C./minute.

In still another example embodiment of the present invention, sulfone loading capacities of the mesoporous adsorbents are determined by equilibrating mesoporous adsorbent with hydrocarbon fuel containing known concentration of sulfur in the form of sulfones at temperature in the range of 30 to 80° C.

In still another example embodiment of the present invention, regenerable mesoporous silica adsorbents with narrow pore size distribution, are used for the dynamic adsorption of sulfones obtained by oxidation of the organo-sulfur compounds, such as thiophene, substituted thiophenes, benzothiophene, substituted benzothiophenes, dibenzothiophene, and substituted dibenzothiophenes present in hydrocarbon fuels for example diesel fuels, gasoline, jet fuel oils, coal liquids, lube oils, waxy distillates and similar petroleum products like straight run kerosine, light cycle oil, vacuum gas oil etc. by a suitable oxidizing agent.

In still another example embodiment of the present invention, the dynamic sulfone adsorption process is carried out by passing a pre-oxidized hydrocarbon fuel containing sulfones in to a fixed bed of mesoporous adsorbent at a controlled flow rate corresponding to a Weight Hourly Space Velocity (WHSV) value in the range of 1 to 20 $h^{-1}$ but preferably in the range of 1 to 10 $h^{-1}$.

In still another example embodiment of the present invention, the temperature of the adsorbent bed is kept at constant value in the range of 20° C. to 150° C. but preferably in the range of 50 to 80° C. during fixed bed dynamic adsorption of sulfone from oxidized hydrocarbon fuels.

In still another example embodiment of the present invention, the effluent liquid from the fixed bed of mesoporous adsorbent during the dynamic adsorption process is analysed at regular intervals of time for total sulphur content. The passage of the pre oxidized hydrocarbon feed into the fixed bed of adsorbent is terminated when the total sulphur concentration in the effluent reaches a certain predetermined level. This defines the Adsorption Cycle of the process.

In still another example embodiment of the present invention, regeneration of the loaded or spent mesoporous adsorbent is started by counter currently flowing through the adsorbent bed, a polar solvent such as methanol, ethanol, acetone or any other solvent or mixture of solvents as may be found suitable for the purpose.

In still another example embodiment of the present invention, effluent from the adsorbent bed during the regeneration cycle is analysed for total sulphur content at regular intervals of time and countercurrent flow of polar solvent (regenerant) is terminated when the total sulphur content drops to below detection limits This defines the regeneration cycle of the process.

In still another example embodiment of the present invention, the bed can be reused for the succeeding adsorption cycle by first draining the solvent from the bed and finally by stripping off the solvent regenerant in the interstices of adsorbent particles with a hot inert gas purge such as nitrogen or the like.

In still another example embodiment of the present invention, the spent regenerant may be reused after separating sulfones from it by any suitable process step like distillation.

DETAILED DESCRIPTION OF EXAMPLE EMBODIMENTS

One main objective of some example embodiments of the present invention is to provide a process for the removal sulfones from oxidised hydrocarbon fuels by using modified mesoporous materials as selective adsorbents.

Another objective of some example embodiments is to provide a process for the removal of sulfones by using modified mesoporous silica based adsorbents from oxidized hydrocarbon fuels such as diesel fuel, gasoline, jet fuel, fuel oils, coal liquids and similar petroleum products.

Still another object of some example embodiments of the present invention is a process for the removal of sulfones by mesoporous silica based adsorbents of different pore sizes and narrow pore size distribution which can be controlled to specification for the adsorption of sulfones, obtained by oxidation of the organo-sulfur compounds, such as thiophene, substituted thiophenes, benzothiophene, substituted benzothiophenes, dibenzothiophene and substituted dibenzothiophenes present in hydrocarbon fuels for example diesel fuels, gasoline, jet fuel oils, coal liquids, lube oils, waxy distillates and similar petroleum products, by a suitable oxidizing agent.

Figure 1:
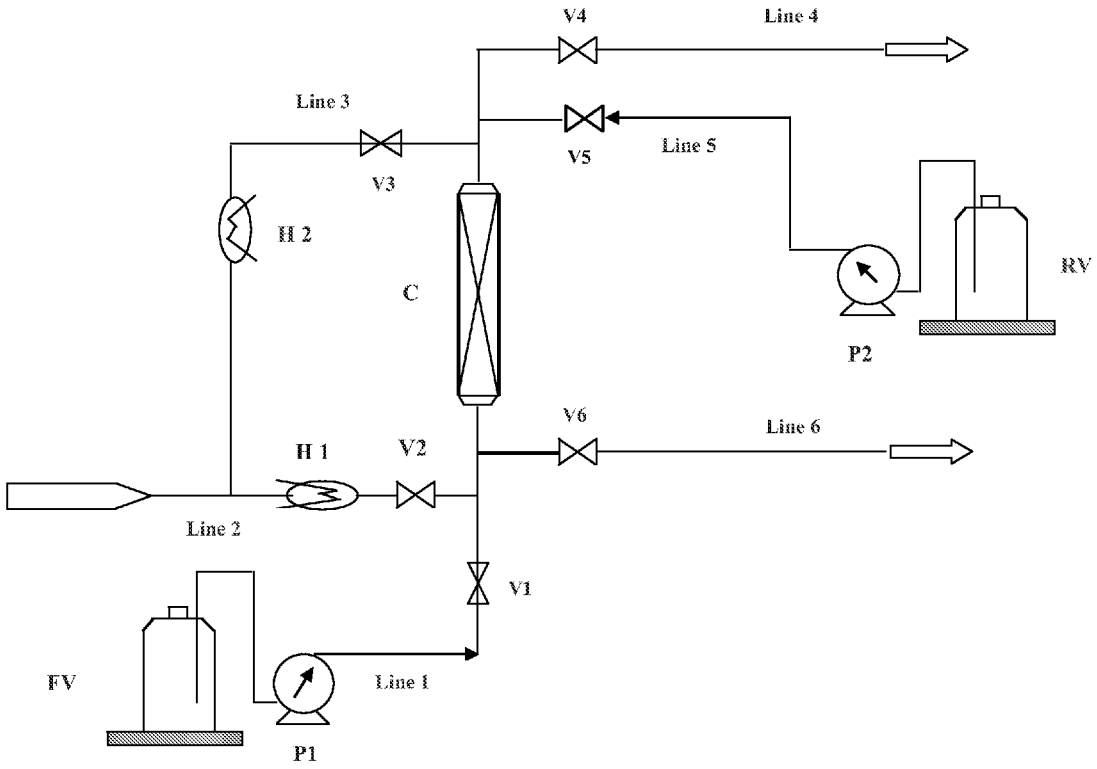
FIG. 1 shows a schematic line diagram of an example process, according to an example embodiment of the present invention.

FIG. 1 shows a schematic line diagram of an example process, according to an example embodiment of the present invention. The column is positioned inside a tubular furnace (not shown in FIG. 1 for brevity) whose temperature can be controlled with the help of PID controller. The column C is heated to the required temperature in the temperature range 150 to 350° C. and dry inert gas like nitrogen is introduced into the adsorbent loaded column through LINE 2 and opening the valve V2 after heating the gas with the help of gas pre-heater H 1. This step is continued for 2 to 6 hrs for conditioning of the adsorbent by way of moisture removal. During this step valve V4 remains open for the exit of the hot purging gas. All other valves except V2 and V4 remain closed during this step.

Adsorption Step:

The column temperature is brought down to the adsorption temperature and hydrocarbon feed from feed vessel FV containing oxidized organo-sulphur compounds in the form of sulfones, is pumped at a fixed flow rate with the help of feed pump P1 to the adsorbent loaded column C through LINE 1 and opening the valve V1. The product, desulphurised hydrocarbon fuel, is collected through LINE 4 through the open valve V4 and analysed for total sulphur content at regular intervals of time. Valves V2, V3, V5 and V6 and the pump P2 remains closed during this step.

Solvent Regeneration Step:

When sulfone concentration in the product stream during the adsorption step exceeds the required level, the valves V1 and V4 are closed respectively and the feed pump P1 is stopped. The liquid filled column is drained by opening the valve V6 via LINE 6. The drained liquid whose sulfone concentration is normally slightly less than the feed sulfone concentration can be blended to the original feed for use in subsequent cycles as feed.

The countercurrent solvent regeneration step is then started. During this step the valve V5 is opened and the solvent regenerant stored in the regenerant vessel RV is pumped at a fixed flow rate with the help of regenerant pump P2, into the sulfone loaded column C through Line 5 while the sulfone laden regenerant is collected through Line 6 by the open valve V6. This sulphone laden regenerant is analysed for total sulphur content at regular intervals of time. The pumping of regenerant is terminated when the sulphur content drops below 1 ppm.

Regenerant Removal Step:

When sulfone concentration in the regenerant washing falls down below 1 ppm the regenerant pumping is stopped, the valve V6 is opened and the regenerant in the column is allowed to drain out and is sent for regenerant recovery. Finally, hot inert gas is introduced to the column through Line 3 by opening of the valve V3. The regenerant vapours coming out of the Line 6 can be condensed and recycled back to regenerant recovery step.

Regenerant Recovery Step

The spent regenerant from solvent regeneration and regenerant removal step is distilled to recover sulfur free regenerant as distillation column overheads and concentrated sulfur hydrocarbon mixture as distillation column bottoms.

The following examples are given by way of illustration of the working of example embodiments of the present the invention in actual practice and should not be construed to limit the scope of the present invention in any way:

Example 1

This example describes the preparation procedure of a MMS class siliceous mesoporous sulfone adsorbent and its equilibrium sulfone loading capacity measurement from an oxidized diesel fuel. For the preparation of MMS class mesoporous sulfone adsorbent, cetyl trimethyl ammonium bromide (CTAB, 4.04 gm) and NaOH (1.36 gm) were dissolved in 60 ml of distilled water each in separate flasks to make aqueous solutions. Aqueous solution of NaOH was added to the aqueous CTAB solution and stirred for 30 minutes to stabilize the pH of the solution. To this homogeneous mixture, 23.12 gm of TEOS was added drop wise in a time span of 90 minutes at room temperature with magnetic stirring. While adding TEOS, a milky white slurry gradually developed, which was further stirred at room temperature for 90 minutes. The slurry was then heated at 80° C. for one hour in a constant temperature water bath followed by cooling to room temperature and adjusting the pH to 11.1 by adding concentrated solution of sodium hydroxide. The slurry was then poured into a Teflon beaker which was placed into a Stainless Steel (SS) hydrothermal bomb and kept in an oven at 90° C. under autogenous pressure for 96 hrs. The product was then filtered and the solid obtained was washed with copious amount of distilled water. The solid product was then dried at 80° C. in an oven for overnight. Finally the solid was calcined in a temperature programmed furnace under air flow of 300 ml/min. The programming of the furnace temperature was carried out in the following sequence.

- Ambient to 200° C. at a heating rate of 1° C./min and holding this temperature for 2 hrs
- Further heating from 200° C. to 550° C. at a rate of 5° C./min and keeping the solid at this temperature for 10 hrs.

The equilibrium loading capacity was measured by taking 1 gm of the adsorbent in a jacketed conical flask and adding 30 ml of the oxidized diesel containing 470 ppm of total sulphur. The characteristics of the oxidized diesel are presented in Table-2. The contents of the conical flask were shaken at 40° C. for 24 hrs to ensure the equilibrium state. After shaking, the contents of the flask were filtered and filtrate analysed for total sulfur. The equilibrium loading capacity (Table 3) was calculated by taking the difference of sulfur present in feed and in the equilibrated oxidized diesel using the formula $$Q = \frac{[Cf - Ce]}{W} \quad (1)$$

Where $C_f$ and $C_e$ is the sulfur concentration (mg/l) in oxidized diesel feed and equilibrated liquid respectively as determined by X ray fluorescence or UV fluorescence method; W is the adsorbent dosage (g/l). Q indicates sulfur loading (mg/g) on the adsorbent at equilibrium.

Example 2

This example illustrates the preparation of a cerium incorporated siliceous mesoporous sulfone adsorbent of MMS class (Ce-MMS). In a typical preparation, CTAB (4.41 gm) and NaOH (1.36 gm) were dissolved in 60 ml of distilled water each in separate flasks to make aqueous solutions. Aqueous solution of NaOH was added to the aqueous CTAB solution and stirred for 30 minutes to stabilize the pH of the solution. Aqueous solution of 0.482 gm cerium nitrate hexahydrate $(Ce(NO_3)_3).6H_2O$ and 23.12 gm of TEOS was added drop wise into the above homogeneous mixture over a time span of 90 minutes at room temperature with magnetic stirring. While adding TEOS, a milky white slurry gradually developed, which was further stirred at room temperature for 90 minutes. Further details of aging and calcinations have been disclosed in Example 1. The equilibrium loading capacity is reported in Table-3. This metal incorporated adsorbent has not shown any further improvement in loading capacity in comparison to the purely siliceous adsorbent.

Example 3

This example illustrates typical preparation procedure of a pore expanded MMS class mesoporous sulfone adsorbent. In a typical preparation, CTAB (4.41 gm) and NaOH (1.38 gm) were dissolved in 60 ml of distilled water each in separate flasks to make their aqueous solutions. Aqueous solution of NaOH and 4.77 ml of hexane were added to the aqueous CTAB solution and stirred for 30 minutes. TEOS (27.12 gm) was added drop wise into the above homogeneous mixture over a time span of 90 minutes at room temperature with magnetic stirring. Rest of the synthesis procedure is same as described in Example-1. This material is designated as EXP-MMS-H. Following the same procedure, pore expansion of MMS class material was also carried out with toluene as organic co-solvent. This material is designated as EXP-MMS-T. The loading capacity and sulfur reduction performance of these materials is found to be far better than materials reported in Example 1 and 2 and the data is reported in Table-3.

Example 4

This example illustrates the preparation of siliceous mesoporous sulfone adsorbent of MMW (Mesoporus Materials with wide pores in the range of 50-80 angstrom) class using tetraethoxy orthosilicate (TEOS) as silica source, Pluronic™ P123 (Polyethylene oxide-block-Polypropylene oxide-block-Polyethylene oxide of Av. M.W. 6800) as structure directing template, and hydrochloric acid (HCl) to maintain desired acidic pH of the medium. Pluronic™ P123 (20 gms) was completely dissolved in distilled water (150 gm) by vigorous stirring. Next, 600 gm of 2M HCl was added and the mixture was stirred for one hour at room temperature. TEOS (42.5 gm) was added to the above mixture drop wise over a period of one hour. The whole slurry was then stirred at 35° C. for 24 hrs. The slurry thus obtained was aged at 80° C. for 12 hrs without stirring. The precipitate so formed was separated by filtration and the solid was thoroughly washed with distilled water. The solid was then dried at 80° C. overnight followed by calcinations in a temperature programmed furnace under air flow of 200 ml/min in the following sequence: ambient to 550° C. at a heating rate of 1° C./min and maintaining this temperature for 6 hrs. The equilibrium loading capacity of the material was determined in same way as described in Example 1. This material shows comparable performance to the pore expanded MMS material with respect to its sulfur reduction and loading capacities and data is reported in Table 3.

Example 5

Figure 2:
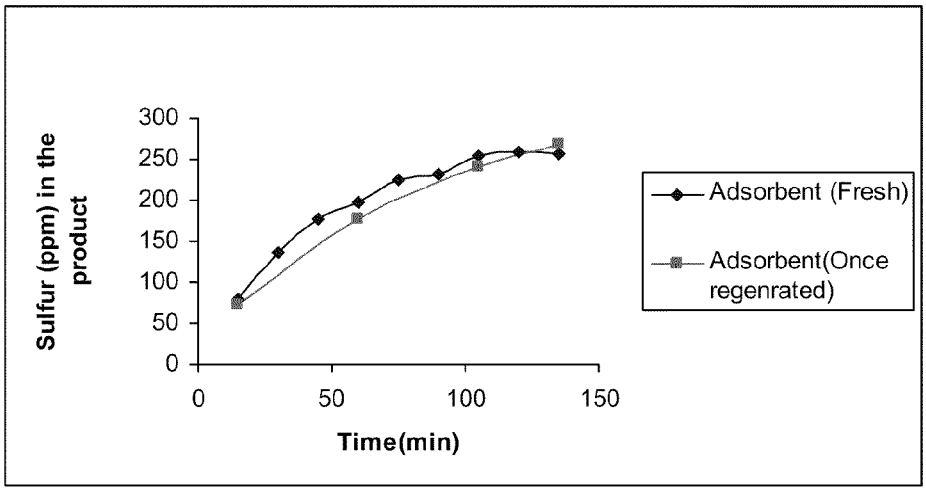
FIG. 2 illustrates a breakthrough curves for oxidized sulfones with fresh adsorbent and also with once regenerated adsorbent.

This example illustrates the working of the fixed bed process for adsorptive removal of oxidized sulphones from a diesel fuel using the above prepared mesoporous adsorbents. The continuous fixed bed adsorption was carried out at ambient temperature (30° C.) and pressure. About 10 gram extrudate of the mesoporous silica adsorbent MMW, dried at 350° C. was loaded into a 1.9 cm diameter glass column. The packed bed height was 10 cm. The oxidized diesel feed containing 100% oxidized sulfones (420 ppm total sulfur) was then passed through the adsorbent bed at a flow rate of 1.3 ml/minute in an up flow mode. The composite effluents were collected every fifteen minutes and were analyzed for total sulfur content by an UV fluorescence analyzer. A typical concentration versus time curve called the "Breakthrough Curve" is shown in FIG. 2. FIG. 2 illustrates a breakthrough curves for oxidized sulfones with fresh adsorbent and also with once regenerated adsorbent. It is a time verses concentration curve showing the concentration of sulfones in the treated exit stream with respect to time.

Example 6

This example illustrates the use of solvent for regenerating the spent mesoporous adsorbent used in the previous example for sulphone removal.

Figure 3:
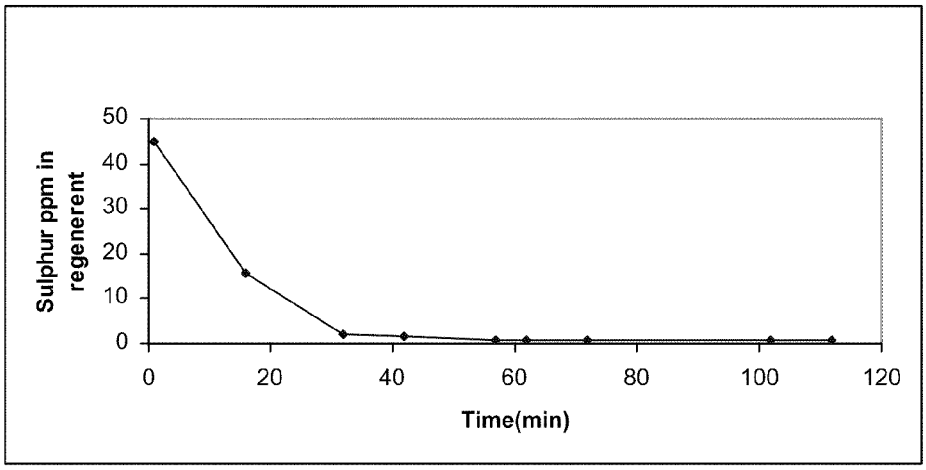
FIG. 3 illustrates a regeneration breakthrough curve showing the concentration of sulfones in regenerent. This is a time verses concentration curve. The concentration of sulphur in the effluent rises slowly with time and it is seen that under the given conditions about 1.4 bed volume of feed could be treated with 80% desulfurization, bringing down the sulphur level from 400 ppm to 80 ppm.

The fully sulfone loaded bed was regenerated by passing solvent acetone in a flow countercurrent to the feed flow. The acetone flow rate was maintained at 7.5 ml/min and the temperature was ambient (27 C). The effluent from the adsorbent bed was analysed at regular intervals of time and a typical concentration versus time curve is shown in FIG. 3. The sulphur concentration in the effluent drops to 0.86 ppm from 350 ppm in 111 minutes of acetone flow. The acetone solvent was next drained from the bed and the bed was purged with hot nitrogen at 90° C.

The oxidized diesel feed containing 100% oxidized sulfones (473 ppm total sulfur) was then passed through the regenerated adsorbent bed at a flow rate of 1.3 ml/minute in an up flow mode. The composite effluents were collected every fifteen minutes and were analyzed for total sulfur content by an UV fluorescence analyzer From the breakthrough curve shown in FIG. 2 it is seen that the adsorbent could be regenerated completely and about 1.4 bed volumes of feed can be treated bringing the sulphur level from 473 ppm to 73 ppm

TABLE 1

Characteristics of Mesoporous Materials

| Material | BET Surface Area ($m^2/g$) | Pore Volume ($cm^3/g$) | Pore Size BJH Adsorption (Å) |
|---|---|---|---|
| MMS | 702.5 | 0.446 | 26.4 |
| Ce-MMS | 703.2 | 0.642 | 30.6 |
| EXP-MMS-H | 817.0 | 0.700 | 27.0 |
| EXP-MMS-T | 925.7 | 0.832 | 28.9 |
| MMW | 777.5 | 0.837 | 56.9 |

TABLE 2

Characteristics of Diesel Feed Stock

| Characteristics | HDS Diesel Feedstock |
|---|---|
| RI at 20° C. | 1.4658 |
| Density at 20° C. | 0.8334 |
| Aromatics wt % (ASTM 2549) | 24.5 |
| Total sulphur | 473 |
| Cetane Index | 57.8 |
| ASTM D 86 | |
| IBP | 167.9 |
| 5% Recovered, oC | 216.7 |
| 10% Recovered, oC | 230.8 |
| 50% Recovered, 0C | 281.8 |
| 90% Recovered, 0C | 347.8 |
| FBP | 376.7 |
| Class type analysis wt % | |
| Total saturates | 72.6 |
| Mono aromatics | ND |
| Poly aromatics | ND |
| Total aromatics | 27.4 |

TABLE 3

Comparison of Equilibrium Sulfur Loading Capacities of Mesoporous Adsorbents against Commercial Adsorbents from a Diesel Fuel whose Sulfur Compounds are Completely Oxidized to Sulfones

| Adsorbents | Equilibrium Loading Capacity (mg Sulfur/g Adsorbent) |
|---|---|
| ■Act Carbon(F-400) | 4.4295 |
| ■Act Carbon(F-300 | 4.0875 |
| ■Silicagel(6-20 mesh) | 5.1165 |
| ■Alumina Neutral | 1.359 |
| ■Alumina Basic | 0.9156 |
| ■Sodium Zeolite | 0.642 |
| ■XAD-4(Amberlite) | 0.8595 |
| ■XAD-16(Amberlite) | 0.627 |
| *MMW | 11.11041 |
| *MMS | 9.927366 |
| *Ce-MMS | 7.557029 |
| *EXP-MMS-H | 10.81902 |
| *EXP-MMS-T | 11.07417 |

*Mesoporous adsorbents prepared in the present invention
■Commercial Adsorbents

We claim:

1. A process for the removal of sulfones from oxidized hydrocarbon fuels, which comprises passing an oxidized liquid hydrocarbon fuel containing sulfones and substantially no organo-sulfur compounds continuously over a fixed bed containing a modified mesoporous silica adsorbent having a pore size in the range of 26-60 Å, a BET surface area in the range of 700-950 $m^2/g$ and a pore volume in the range of 0.4-0.9 $cm^3/g$, pre-activated at a temperature of 350° C., at a weight hourly space velocity (WHSV) in the range of 1-20 $h^{-1}$, at an adsorption temperature of 20-30° C., at one bar pressure and regenerating the adsorbent by passing an organic solvent over the fixed bed for a time period of 20 to 30 minutes for further adsorption of sulfones.

2. The process as claimed in claim 1, wherein the liquid hydrocarbon fuel used is selected from the group consisting of diesel fuel, gasoline, jet fuel oil and coal liquids and similar petroleum products containing sulfur compounds in the form of sulfones.

3. The process as claimed in claim 1, wherein the modified silica adsorbent used is siliceous material with or without metal impregnation.

4. The process as claimed in claim 3, wherein the metal used is a transition or a non transition metal selected from the group consisting of aluminum, cerium, nickel, copper, iron and titanium.

5. The process as claimed in claim 1, wherein the equilibrium sulfur loading capacity of the modified silica adsorbent used is in the range of 7-11.5 mg/g of adsorbent.

6. The process as claimed in claim 1, wherein the weight hourly space velocity (WHSV) of the hydrocarbon feed is in the range of 1-10 $h^{-1}$.

7. The process as claimed in claim 1, wherein the organic solvent used for regenerating the adsorbent is selected from methanol, ethanol, acetone and mixture thereof.

8. The process as claimed in claim 1, wherein the desulphurization of the hydrocarbon obtained is in the range of 80-90%.

9. The process as claimed in claim 1, wherein the liquid hydrocarbon fuel has a total sulfur content of less than about 500 ppm.

10. The process as claimed in claim 1, wherein the modified mesoporous silica absorbent is a reaction product of a silica precursor and a cationic surfactant having a formula $[(C_nH_{2n+1}N(C_mH_{2m+1})_3]^+X^-$ wherein n=10 to 20, m=1 to 3, and X is a univalent anion or a metal.

11. The process as claimed in claim 10, wherein the metal is a transition or a non transition metal selected from aluminum, cerium, nickel, copper, iron, or titanium.

12. The process as claimed in claim 1, wherein the liquid hydrocarbon fuel has a total sulfur content of at least about 350 ppm.

13. The process as claimed in claim 12, wherein the liquid hydrocarbon fuel has a total sulfur content of at least about 400 ppm.

14. The process as claimed in claim 13, wherein the liquid hydrocarbon fuel has a total sulfur content of less than about 500 ppm.

* * * * *

UNITED STATES PATENT AND TRADEMARK OFFICE

CERTIFICATE OF CORRECTION

PATENT NO. : 8,562,821 B2
APPLICATION NO. : 12/634312
DATED : October 22, 2013
INVENTOR(S) : Anshu Nanoti et al.

It is certified that error appears in the above-identified patent and that said Letters Patent is hereby corrected as shown below:

On the title page, item (73), the Assignees should read as follows:

COUNCIL OF SCIENTIFIC & INDUSTRIAL RESEARCH, INDIA
CENTER FOR HIGH TECHNOLOGY, INDIA

Signed and Sealed this
Twenty-fourth Day of June, 2014

Michelle K. Lee

Michelle K. Lee
*Deputy Director of the United States Patent and Trademark Office*